US006890141B2

(12) United States Patent
Freund et al.

(10) Patent No.: US 6,890,141 B2
(45) Date of Patent: May 10, 2005

(54) METHOD AND DEVICE FOR TRANSPORTING AND ROTATING STACKS OF SHEET-FORM PRINT MATERIALS

(75) Inventors: Michael Freund, Adelberg (DE); Alexander Hirsch, Kirchheim (DE); Harald Mauz, Ehingen (DE); Albert Rieger, Geislingen (DE); Hans-Peter Würschum, Ostifildern (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 56 days.

(21) Appl. No.: 10/447,741

(22) Filed: May 29, 2003

(65) Prior Publication Data

US 2004/0069594 A1 Apr. 15, 2004

(30) Foreign Application Priority Data

May 31, 2002 (DE) ..... 102 24 303

(51) Int. Cl.[7] ..... B65G 57/08
(52) U.S. Cl. ..... 414/788.5; 198/409
(58) Field of Search ..... 414/788.5, 792.2; 198/400, 404, 409, 411

(56) References Cited

U.S. PATENT DOCUMENTS 4,798,278 A * 1/1989 Cornacchia ..... 198/399
5,201,399 A * 4/1993 Dietrich ..... 198/409
6,296,246 B1 * 10/2001 Boorsma ..... 271/186
6,527,100 B2 * 3/2003 Ballestrazzi et al. ..... 198/373
2001/0010282 A1 8/2001 Ballestrazzi

FOREIGN PATENT DOCUMENTS

DE 36 08 870 A1 3/1986
EP 1 122 198 A3 12/2002

OTHER PUBLICATIONS

Abstract for DE 3608870 A from Derwent World Patents Index (1986–265508).

DE Search report for DE 102 24 303.4.

Translation of relevant portions of DE Search report for DE 102 24 303.4.

Translation of DE 102 24 303.4 (priority document).

* cited by examiner

*Primary Examiner*—Richard Ridley
(74) *Attorney, Agent, or Firm*—Laurence A. Greenberg; Werner H. Stemer; Gregory L. Mayback

(57) ABSTRACT

The invention relates to a method and device for transporting and rotating sheet-form print material. A rotation unit carried on a transport unit is moveable along a carriage guide. A gripper on the rotation unit holds the sheet form print material. Mechanical interaction between the rotation unit and the carriage guide causes the gripper to rotate.

21 Claims, 4 Drawing Sheets

METHOD AND DEVICE FOR TRANSPORTING AND ROTATING STACKS OF SHEET-FORM PRINT MATERIALS

The invention relates to a method and device for transporting and rotating sheet-form print material.

Typically, devices of the type named are used in a print further-processing device to move stacks of sheet-form print materials that will be bound, or are already bound, from one processing station to the next or to stack them in a storage unit. What is important is that the sheet-form print materials in the stack do not lose their alignment to each other, since otherwise errors would occur during, for example, the outside edge processing of the stack of sheet-form print materials. Another error that could otherwise occur is that punched holes, e.g. for a wire comb binding, plastic comb binding or spiral binding can slip, which leads to later problems when threading through a corresponding binding element.

In these cases, the rotation of a stack of sheet-form print materials is usually especially complicated since the stack of sheet-form print materials is exposed to torques that necessitate adequately protecting the individual sheet-form print materials against slipping. In addition, turning and transporting of stacks of sheet-form print materials generally require a relatively large amount of space; for a combined movement, the space requirement increases even more.

A number of devices for transporting and rotating books in sheets are known from the prior art. European Patent Application EP 1 122 198 A2 shows e.g. a turning device for books in sheets. In this process, a book in sheets is transported between two endless transport belts that are mounted on a turning unit. As soon as the book in sheets is located completely between the two endless transport belts, the book in sheets is fastened in this position, the entire turning device is rotated 180°, the book in sheets is released again and transported further. However, the device shown there is not very suitable for unbound stacks of sheet-form print materials since the book in sheets must first ascend a slope between two transport bands. In this case, the axis of rotation is parallel to one of the outside edges of the book in sheet's pages.

The German OLS DE 36 08 870 A1 shows another conveyor device in which stacks of sheet-form print materials that are securely fastened to holding elements are turned 180°. The force of the rotation is provided to the device from a lifting roller that can optionally be connected to a fixed curved rail and be fastened at the axis of rotation via a lever. The axis of rotation is normal to the plane of the sheet-form print materials and has a slight deviation from the vertical.

In further processing devices having the most compact construction possible, the spatial requirement and energy requirement of the individual components play a critical role. A transport device for stacks of sheet-form print materials or books in sheets takes up a lot of space within the system. The space cannot be used by other units within the system, in order not to have conflicts between a stack of sheet-form print materials that is passing by and the transport device holding them unless there is a complicated synchronizing of the units that at times use the same space within the system.

During rotation of a stack of sheet-form printed materials, the required space for the transport/rotation unit considerably increases. The smallest spatial requirement is generally needed if the axis of rotation is normal to the surface of the sheet-form print materials and at a right angle to the transport device for the stack of sheet-form print materials.

SUMMARY OF THE INVENTION

According to various aspects of the invention, methods and devices are provided for transporting and rotating sheet-form print material.

DETAILED DESCRIPTION

Figure 1:
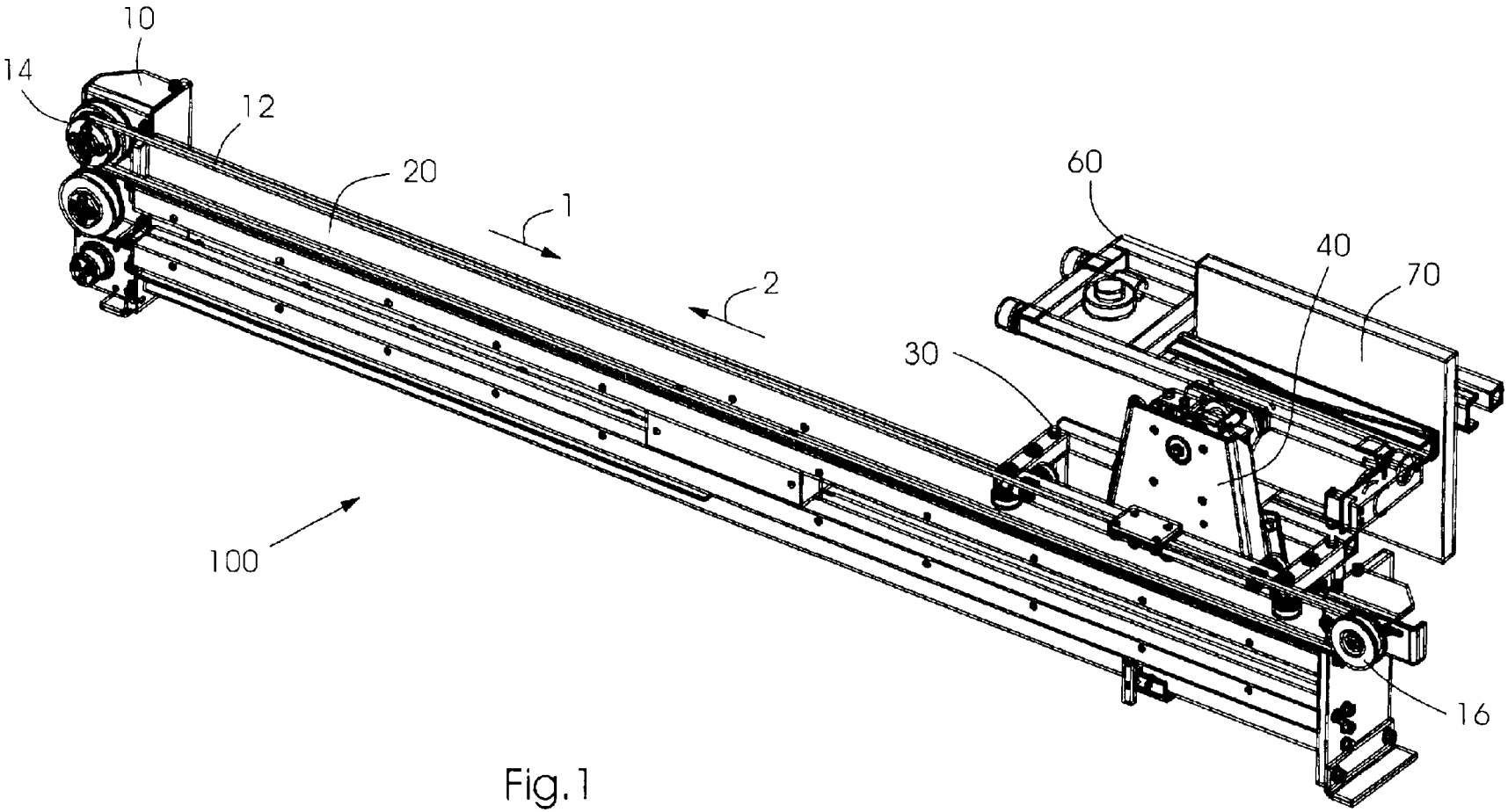
FIG. 1 presents a schematic representation of a device according to one aspect of the invention.

Various aspects of the invention are presented in FIGS. 1–4, which are not drawn to any particular scale, and wherein like components in the numerous views are numbered alike. Referring now specifically to FIG. 1, a device 100 is presented, according to one aspect of the invention. Generally known drive and/or guiding means and cams implemented for operating the device 100 are shown only schematically and/or are only described in a general way, since suitable apparatus and methods are known in the relevant arts. The device 100 comprises a carriage guide 20, on one side of which a drive 10 is mounted. Drive 10, e.g. an electric motor, drives a pulley 14. A belt 12 is held by the pulley 14 and a pulley 16 mounted at the other end of carriage guide 20. A suitable transmission can also be connected between pulley 14 and drive 10, depending on the performance characteristics of drive 10.

The transport unit 30 is mounted on the carriage guide 20 so that it can move. A belt connection 34 (see FIG. 2) is mounted on the endless belt 12 so that it cannot slip. Movement of the belt drive is transferred to movement of transport unit 30 along the carriage guide 20.

Figure 3:
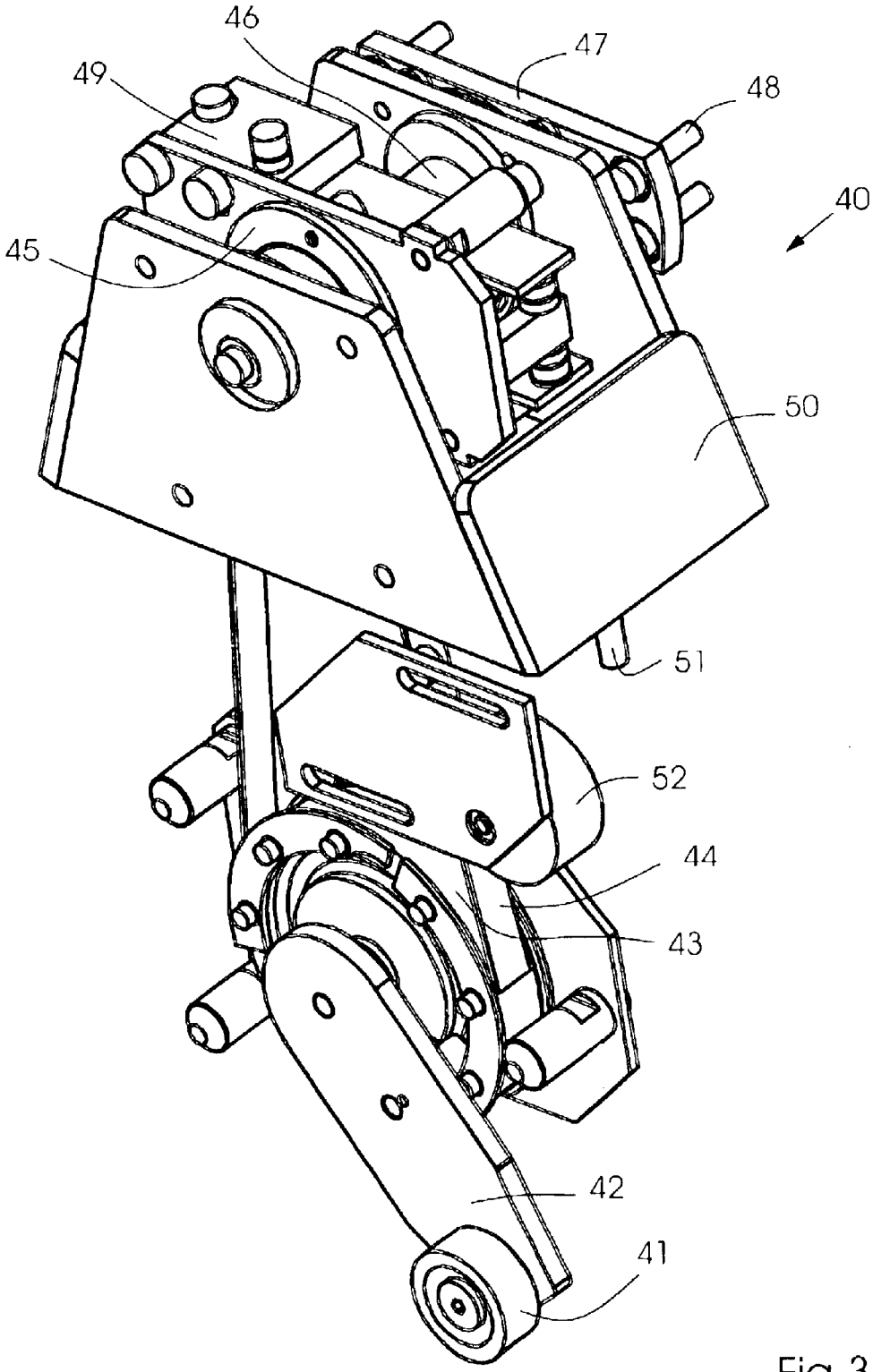
FIG. 3 presents a schematic representation of a rotation unit according to one aspect of the invention.

The transport unit 30 holds a rotation unit 40, presented in FIG. 3. A gripper 60 is mounted on the rotation unit 40, which can tightly clamp a stack of sheet-form print materials 70. The gripper 60 may be configured as tongs, for example.

Referring again to FIG. 2, the transport unit 30 moves, together with rotation unit 40 and gripper 60, in the direction of the arrows identified with reference numbers 1, 2 along carriage guide 20 in a first transport direction 1 and/or second transport direction 2. In this process, in the transport direction 1, gripper 60 is loaded with a stack of sheet-form print materials 70 and unloaded in second transport direction 2.

Figure 2:
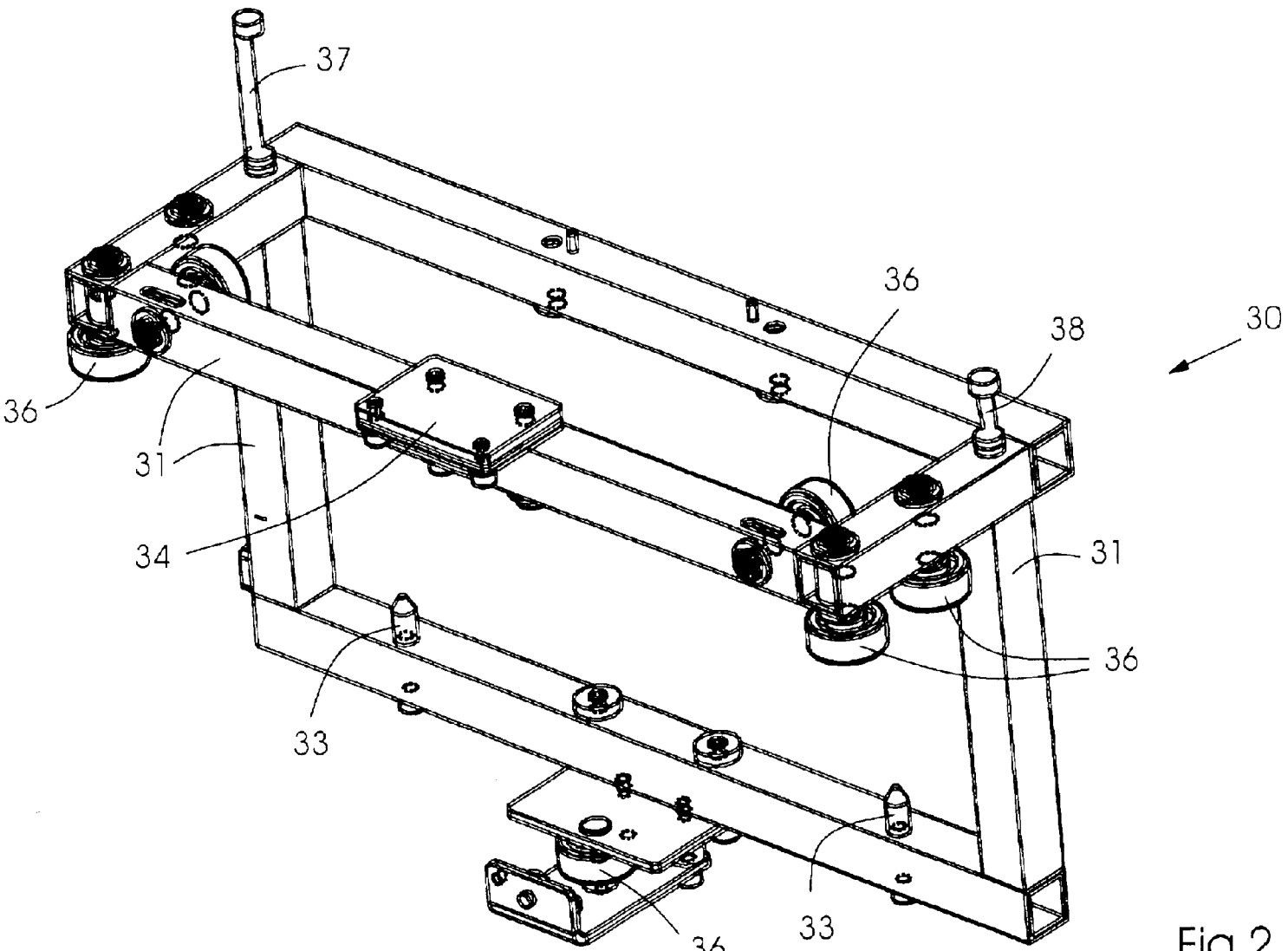
FIG. 2 presents a schematic representation of a transport unit according to one aspect of the invention.

FIG. 2 shows transport unit 30 of device 100 according to an aspect of the invention. Frame 31 of transport unit 30 is made up of a number of rectangular hollow profiles, preferably manufactured of steel or aluminum, thereby leading to a greater stability of transport unit 30 with lighter construction.

On frame 31, seven rollers 36 are mounted in ball bearings, preferably plastic injection-coated ball bearings with round running surfaces. Rollers 36 are each assigned to eccentrics (not shown) that are known to the person skilled in the art, by means of which the positions of rollers 36 are individually adjustable in order to compensate tolerances in manufacturing and installation and to ensure that rollers 36 roll within carriage guide 20 in a manner that is as free of friction as possible.

On frame 31 of the transport unit 30, two stops 37, 38 are mounted for the limit positions of the rotary movement of gripper 60 and limit the movement of the gripper. The stops 37 and 38 are optional. In addition, positioning pins 33 having conical tips are mounted on frame 31 of transport unit 30 into which rotation unit 40 is inserted so that rotation unit 40 has a defined position with respect to transport unit 30. The conical tips of the positioning pins 33 make installation of rotation unit 40 and transport unit 30 easier and ensure exact alignment between rotation unit 40 and transport unit 30.

Figure 4:
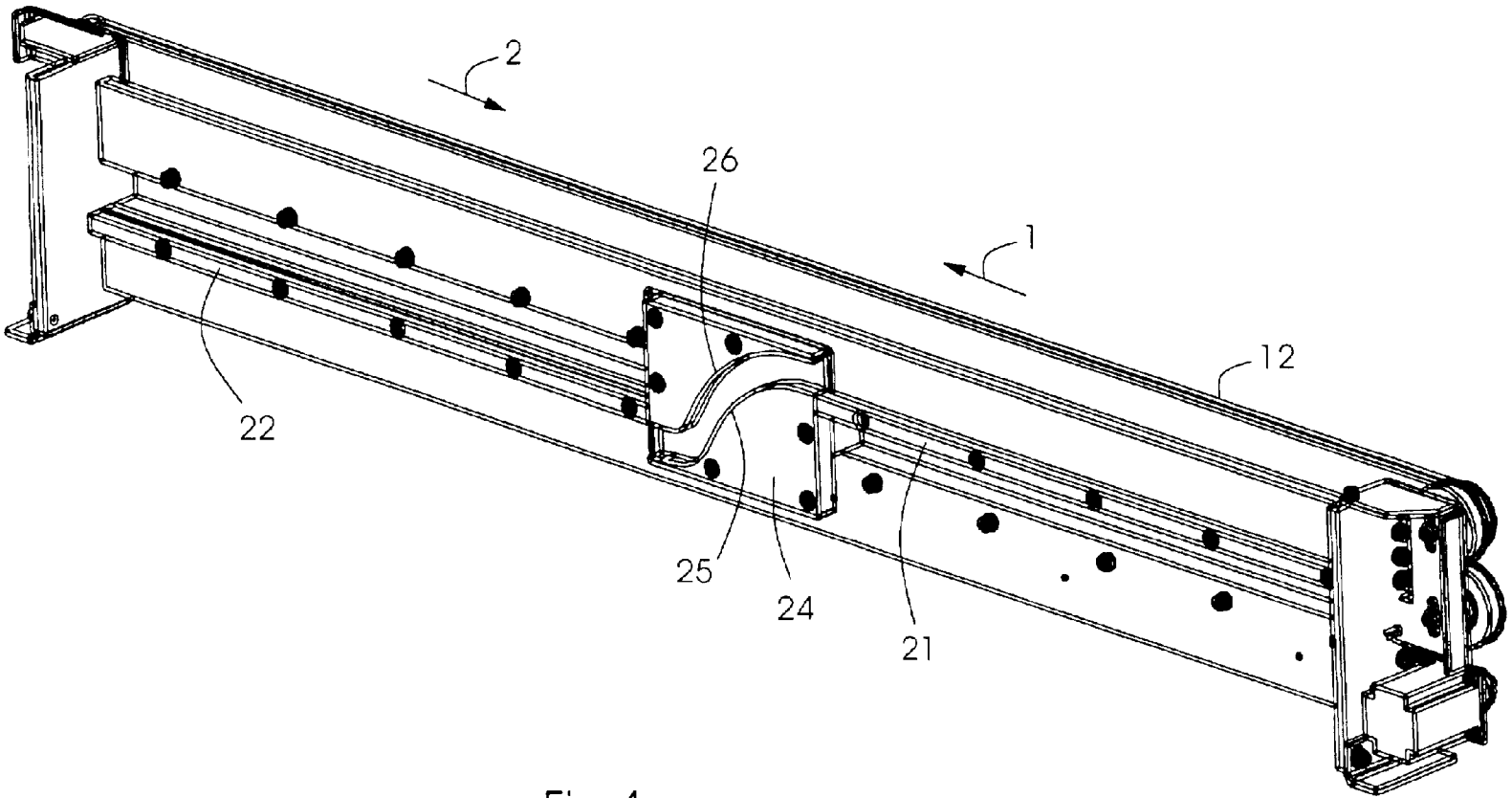
FIG. 4 presents a schematic representation showing a cam of the rotation unit according to one aspect of the invention.

FIG. 3 shows rotation unit 40 in detail. A lever roller 41 that is mounted on a lever 42 with a ball bearing runs on guides 21 and 22, and cam section 24, as shown in FIG. 4. The cam section 24 has two cam surfaces 25 and 26 and is intermediate opposing ends of the carriage guide 20. Referring again to FIG. 3, lever 42 is connected to a first timing pulley 43, around which a timing belt 44 runs. Timing belt 44 also runs around a second timing pulley 45. In this process, timing belt 44 is pre-stressed by a belt tightener 52. The ratio of the number of teeth in the first timing pulley 43 and the number of the teeth in the second timing pulley is 2 to 1.

The second timing pulley 45 runs on a shaft 46, which can be coupled on the other side with a connection 47 on gripper 60. For exact positioning between rotation unit 40 and gripper 60, four pins 48 are used that extend into gripper 60.

Rotation unit 40 has a frame 50 in which rotation unit 40 is connected to transport unit 30. Rotation unit 40 also has guide pins 51 to ensure exact positioning between rotation unit 40 and transport unit 30.

In addition, rotation unit 40 has a spring unit 49. Since gripper 60 is preferably positioned exactly horizontally. The position of the gripper 60 is defined by the aforementioned stops 37, 38 on the transport unit. The stops 37, 38 and rotation unit 30, especially lever roller 41 and guide 21 (FIG. 4), are dimensioned to provide a small interference with the guide 22 that forces the lever 42 to turn somewhat further upon installation so that the gripper 60 is tensioned against the stops 37, 38 and the lever roller 41 is tensioned against the guide 21. In such manner, any looseness due to tolerances and/or expansions in the system is compensated for by the spring unit 49.

At this point, in a first position of lever 42, the function of spring unit 49 will be described using the guides 21, 22 and cam surfaces 25, 26 that lever roller 41 contacts. If transport unit 30 and rotation unit 40 are located on the other side of carriage guide 20 (the right side of FIG. 4), lever 42 is turned 91° relative to a beginning position on the opposite side of the carriage guide 20 (the left side of FIG. 4), and the roller 41 moves from a position below the guide 22 mounted below to above the guide 21. Since in this case gripper 60 has turned, the tension relationships in belt 44 reverse and lever roller 41 is pressed from below (underneath) onto guide 22, comparable to the first case described. In other words, the roller 41 is pressed onto curved section 21 from above, and onto guide 22 from underneath.

FIG. 4 shows the guides 21, 22, and cam section 24 in detail. Guides 21 and 22 are straight and each have an exposed guide surface that the roller rides on. If transport unit 30, together with rotation unit 40 and gripper 60, are located on the right side of guide 21, the lever is pre-stressed against guide 21 as described above.

During the movement in the first transport direction 1, lever roller 41 is guided in the area of the cam section 24 along first cam surface 25 and in this process the lever 42 is swiveled 91°, which leads to a rotation of the gripper 60 by essentially 180°. As soon as gripper 60 is swiveled through the center, lever roller 41, because of the changed weight ratios, contacts the second cam surface 26 in the area of the intermediate section 24. Rotation of gripper 60 further than 180° is prevented by stops 37, 38 already mentioned above. Then lever roller 41 runs against the guide 22. On the return path in second transport direction 2 (opposite to transport direction 1), the movement of lever roller 41, and thus of gripper 60, reverses.

If transport unit 30, together with rotation unit 40 and gripper 60, is located on the right side of guide 21 pictured in FIG. 4, the rotation unit can simply be taken out toward the top, for maintenance purposes, for example.

As shown in FIG. 4, the structure of cam surfaces 25 and 26 are asymmetrical in intermediate section 24. First guide 25 has, in the first transport direction 1, a lesser inclination than the second guide 26 in the second transport direction 2. Because of this, the rotation of the loaded gripper 60 in the first transport direction 1 is started more gently than the rotation of the unloaded gripper 60 in second transport direction 2. The more gentle handling of gripper 60 in the first transport direction 1 is taken into account in order to decrease the stress on loaded gripper 60 and thus decrease the risk of a slipping stack of sheet-form print materials. The braking of the loaded gripper is cushioned in the first transport direction 1 by the spring unit 49 so that, even during braking of the gripper 60, there is no displacement of the individual sheet-form print material in the stack 70.

Because of the concentration of the movement of gripper 60 within the intermediate section 24, independent of the format of the stack of sheet-form print materials 70, the gripper 60 can continuously be turned at the same location and without an additional drive for rotation of the gripper 60. The entire turning movement is derived completely from drive 10 of transport unit 30.

According to a preferred embodiment of the invention, the force needed to rotate the gripper that hold the stack of sheet-form materials is derived completely from translational transport movement along a cam. It is especially advantageous that the movement of the lever along with the lever roller may be transmitted by a set of gears. Because of this, the rotation of the gripper of essentially 180° can be achieved by a smaller rotation of the lever, which leads to a simpler structure, especially in the area of the cam. A significant advantage in the use of a set of gears for transmission of the curve movement is that the rotation of the gripper may be carried out at a different angular speed than that of the lever. Because of this, the rotation of the gripper can be accelerated considerably. In an advantageous manner, the transmission has the ratio of 1 to 2 between movement of rotation of the lever to rotation movement of the gripper.

In an advantageous embodiment according to an aspect of the invention, the rotation unit may be installed in the transport unit so that it can be detached. This is advantageous for maintenance work that may be needed, repairs or replacement of the rotation unit and also makes installation of the device according to the invention easier. Advantageously, the transport unit may have guiding elements onto which the rotation unit is installed so that the rotation unit has a defined position with respect to the transport unit. Because of this, an especially fast, precise and repeatable installation of the rotation unit in the transport unit may be possible.

In an especially advantageous embodiment according to an aspect of the invention, the cam has a short curved section on which the rotation unit completely executes a rotation of the gripper by essentially 180°. Because of this, the entire rotation of the gripper and, thus, of the stack of sheet-form print materials may be carried out at a specified location.

This may be advantageously in the center of the transport path of the stack of sheet-form print materials so that the rotating gripper have as much room as possible to carry out the rotation. At the same time, the space required for rotation is nevertheless concentrated in a small spatial area because of this measure according to the invention. Because of the concentration of the movement in a specific spatial area, the specification for a space requirement that is small overall, for one thing, can be addressed. For another thing, stacks of sheet-form print materials having all different dimensions that are provided for use with the device according to the invention can be rotated uniformly at the same location without significant fluctuations resulting in the spatial area of the stack of sheet-form print materials. The space provided for executing the rotation of the stack of sheet-form print materials, and the rotation of the gripper connected with it, specifies the maximum dimensions of the sheet-form printed materials that can be used with the device according to the invention.

Advantageously, the cam section may be optimized with respect to the moments of inertia of the gripper. The gripper, or a different clamping device for a stack of sheet-form print materials, may be located in a loaded condition, in which at least the rotation but possibly also the transport of the stack of sheet-form print materials from a first position to a second position takes place within a higher level device. Otherwise, the gripper or another clamping device for a stack of sheet-form print materials are in an unloaded condition, especially in order to come back from the second position, in which the stack of sheet-form print materials were released, to the first position in order to accept a new stack of sheet-form print materials.

The mass moments of inertia of the gripper are different from the mass moments of inertia of the combination of gripper and load, namely by the mass moment of inertia of the stack of sheet-form print materials.

An optimization may be provided in that the cam section is formed such that the rotation of the loaded gripper is executed at lower accelerations than the rotation of the unloaded gripper. If the movement of the loaded gripper is defined as movement in a first transport direction and in the opposite transport direction as a second transport direction, the optimization can advantageously be achieved in that the increase in slope of the cam in the first transport direction is lower at first than the increase in slope in the second transport direction. Because of this, there is an asymmetrical structure of the cam section that takes into account the mass ratios that are asymmetrical between the loaded and the unloaded gripper. Because of the slower acceleration of the stack of sheet-form print materials during rotation achieved by these measures, the required holding force of the gripper that is necessary to press the individual sheet-form print materials of the stack against each other during rotation can be decreased to avoid slipping of the individual pages of the sheet-form print material.

For example, this is important if, after transport and rotation from the gripper, the stack of sheet-form print materials will be subjected to a binding process, e.g. binding using a wire comb, plastic comb or spiral binding. In this process, an appropriate binding element will be threaded through a series of holes provided in the individual pages. The series of holes in the individual sheet-form print materials are caused to line up in the stack. If the individual series of holes are displaced during the rotation, this can lead to considerable complications during the following binding step. Therefore, secure clamping of the individual pages and thus the rotation of the stack of sheet-form print materials that is as gentle as possible is of great importance.

Advantageously, the guide may have a guide surface formed on just one side outside the intermediate section. Because of this, with a suitable design of the rotation unit, this can be taken upward out of the transport unit while the transport unit is still in connection with the carriage guide. In turn, this may make maintenance and/or installation easier.

In an advantageous embodiment according to an aspect of the invention, the rotation unit may have a spring unit that pre-stresses the lever along with the lever roller against the guide. This is especially advantageous with a one-sided design of the guide since because of this, continuous contact of the lever roller with the guide may be ensured.

In an advantageous manner, the rotation unit may have a spring unit that is dimensioned in such a way that the mass inertias of the loaded gripper are absorbed at the end of rotation. This is used in turn for a gentler braking of the rotation operation having the advantages described above. In this case, it is especially advantageous if this spring unit is the same spring unit that also pre-stresses the lever roller on the guide.

In an advantageous embodiment according to an aspect of the invention, the transmission is a timing belt drive with a timing belt and two timing belt pulleys. A timing belt is suitable, on the one hand, for damping the movements because of its elasticity, and, on the other hand, the teeth prevent the belt from slipping on the pulleys.

Although the invention was described in reference to preferred exemplary embodiments, the invention is not restricted to them, but can undergo changes and adaptations within its area of applicability.

What is claimed is:

1. A device for transporting and rotating stacks of sheet-form print material comprising:

a carriage guide having a cam;

a transport unit carried on the carriage guide, the transport unit being moveable along the carriage guide;

a rotation unit carried on the transport unit and comprising a gripper, a lever roller on a lever mounted to the rotation unit, the lever roller contacting the cam, and a transmission interconnecting the lever and the gripper that transmits rotary movement of the lever to rotary movement of the gripper.

2. The device of claim 1, wherein rotary movement of the lever and rotary movement of the gripper is proportional.

3. The device of claim 1, comprising a transmission ratio of 1 to 2 between rotary movement of the lever and rotary movement of gripper.

4. The device of claim 1, wherein the lever and the gripper are interconnected by gears.

5. The device of claim 1, wherein the lever and gripper are interconnected by a belt.

6. The device of claim 1, wherein the lever and gripper are interconnected by a timing belt.

7. The device of claim 1, wherein the rotation unit is removable from the transport unit.

8. The device of 1, wherein the transport unit has guiding elements on which the rotation unit is mounted so that the rotation unit has a defined position with respect to the transport unit.

9. The device of claim 1, wherein the transport unit is removable from the carriage guide.

10. The device of claim 1, wherein the cam is disposed intermediate a pair of guides on the carriage guide, and the rotation unit executes a rotation of the gripper by essentially 180° through interaction with the cam.

11. The device of claim 1, wherein the rotation unit comprises a spring unit that pre-stresses the lever with the lever roller against the cam.

12. A device for transporting and rotating stacks of sheet-form print material comprising:

a carriage guide having a cam;

a transport unit carried on the carriage guide, the transport unit being moveable along the carriage guide;

a rotation unit carried on the transport unit and comprising a gripper that holds sheet-form print materials, a lever roller on a lever mounted to the rotation unit, the lever roller contacting the cam, a spring unit that loads the lever with the lever roller against the cam, and a transmission interconnecting the lever and the gripper that transmits rotary movement of the lever to rotary movement of the gripper wherein the rotation unit executes a rotation of the gripper by essentially 180°.

13. The device of claim 12, wherein rotary movement of the lever and rotary movement of the gripper is proportional.

14. The device of claim 12, comprising a transmission ratio of 1 to 2 between rotary movement of the lever and rotary movement of gripper.

15. A method for transporting and rotating stacks of sheet-form print material comprising:

moving a transport unit along a carriage guide having a cam;

rotating a lever through interaction with the cam, the lever being carried on the transport unit; and, transmitting rotation of the lever to a gripper through a transmission thereby rotating the gripper, the gripper and transmission being carried on the transport unit.

16. The method of claim 15, comprising rotating the gripper essentially 180°.

17. The method of claim 15, comprising moving the transport unit in a first transport direction with sheet-form print material held in the gripper, and moving the transport unit in a second transport direction opposite to the first transport direction without sheet-form print material held in the gripper.

18. The method of claim 15, comprising moving the transport unit in a first transport direction with sheet-form print material held in the gripper, and moving the transport unit in a second transport direction opposite to the first transport direction without sheet-form print material held in the gripper, wherein a first slope of the cam in the first transport direction is less than a second slope of the cam in the second transport direction.

19. The method of claim 15, comprising gripping sheet-form print material at one end of the carriage guide and releasing the sheet-form print material at another end of the carriage guide.

20. The method of claim 15, comprising gripping sheet-form print material at one end of the carriage guide, releasing the sheet-form print material at another end of the carriage guide, moving the gripper back to the one end of the carriage guide without sheet-form print material.

21. The method of claim 15, wherein the lever and gripper are mounted on a rotation unit mounted to the transport unit.

* * * * *